US005264669A

United States Patent [19]

Merten

[11] Patent Number: 5,264,669

[45] Date of Patent: Nov. 23, 1993

[54] MULTI-POSITION SWITCH PARTICULARLY FOR MOTOR VEHICLE

[75] Inventor: Gunter Merten, Malta, Fed. Rep. of Germany

[73] Assignee: Merit-Elektrik GmbH, Gummersbach, Fed. Rep. of Germany

[21] Appl. No.: 936,752

[22] Filed: Aug. 27, 1992

[30] Foreign Application Priority Data

Aug. 27, 1991 [DE] Fed. Rep. of Germany ..... 4128315

[51] Int. Cl.[5] ..... H01H 19/54; H01H 1/16

[52] U.S. Cl. ..... 200/11 K; 200/11 EA

[58] Field of Search ..... 200/11 E, 11 EA, 11 J, 200/11 K, 277

[56] References Cited

U.S. PATENT DOCUMENTS

| | | | |
|---|---|---|---|
| 2,820,126 | 1/1958 | Murray | 200/277 |
| 3,024,334 | 3/1962 | Rhodes | 200/11 K X |
| 3,639,708 | 2/1972 | Wolniak et al. | 200/11 K X |
| 3,683,133 | 8/1972 | Heap | 200/11 EA X |

FOREIGN PATENT DOCUMENTS

| | | |
|---|---|---|
| 1694862 | 5/1954 | Fed. Rep. of Germany . |
| 1993598 | 6/1968 | Fed. Rep. of Germany . |
| 3219853 | 12/1983 | Fed. Rep. of Germany . |
| 3315994 | 11/1984 | Fed. Rep. of Germany . |
| 3441161 | 4/1986 | Fed. Rep. of Germany . |
| 2909585 | 9/1990 | Fed. Rep. of Germany . |

*Primary Examiner*—J. R. Scott
*Attorney, Agent, or Firm*—Michael J. Striker

[57] ABSTRACT

A multiple switch, particularly for a motor vehicle, has a switch base, an input fixed contact arranged on the switch base, a plurality of output fixed contacts which can be connected with the input fixed contact, a ramp, contact bridges controlled by the ramp and bringing the output fixed contacts in contact with the input fixed contact, a driver movable relative to the switch base and individually supporting and guiding the bridges, springs providing a required contact pressure between the contact bridges and the input fixed contact and the contact bridges and the output fixed contacts. Each of the contact bridges have axle which is freely rotatable relative to the driver and carries a contact roller. Each of the contact bridges or the contact roller is provided with a control part which comes into contact with the ramp has a peripheral surface which produces a rubbing friction for turning the contact bridge or the contact roller about its longitudinal axis.

8 Claims, 2 Drawing Sheets

MULTI-POSITION SWITCH PARTICULARLY FOR MOTOR VEHICLE

BACKGROUND OF THE INVENTION

The present invention relates to a multi-position switch, in particular for motor vehicles.

More particularly, it relates to a multi-position switch which has an input fixed contact arranged on a switch base and a plurality of output fixed contacts which can be connected with the input fixed contact by one or several contact bridges controlled by ramps and cooperating control parts. The contact bridges are supported on a driver which is turnable or displaceable relative to the switch base under the action of pressure springs which produce the required contact pressure between the contact bridge and the input fixed contact and also between each contact bridge and the fixed contact and which are individually guided. Each contact bridge has an axle which freely rotatable relative to the driver and rolls with a contact roller on the output fixed contacts and directly cooperates through a control part with the control ramp.

A multi-position switch, particularly for a motor vehicle can have an input fixed contact arranged on the switch base and a plurality of output fixed contacts which can be connected with the input fixed contact by one or several contact bridges controlled by ramps and cooperating control parts, with the contact bridges supported on a driver rotatable or displaceable relative to the switch base under the action of pressure springs which produce the required the contact pressure between contact bridges and the input fixed contact, and also between the contact bridges and the fixed contact and guided individually. Here, each contact bridge has an axle which is freely rotatable relative to the driver with a contact roller which rolls on the output fixed contacts. The contact roller is arranged rotatably on the axle of the contact bridge and cooperates directly with a control ramp through a control part.

The present invention is a further development of the prior art as disclosed in the German documents DE 34 14 161 A1, DE 33 15 994 C2 and DE 32 19 853 A1.

It has been recognized that in such multi-position with increasing operation life the contact burning between the contact rollers of the contact bridges and the outwardly located fixed contacts can occur at predetermined permanent points. Therefore the operational safety of such switches can be affected without limiting the remaining regions of the contact parts in their operational ability by a contact burning.

German document DE 34 14 161 A1 shows a multi-position switch, especially for a motor vehicle which has a fixed contact arranged on a switch base and a plurality of output fixed contacts which can be connected with the input fixed contact by one or several contact bridges controlled by ramps and cooperating control parts. The contact bridges are supported on a driver which is turnable and displaceable relative to the switch base under the action of pressure springs which produce the required contact pressure between the contact bridge and the input fixed contact and also between the contact bridge and the fixed contact on the other hand and are guided individually. Each contact bridge has either an axle which is freely rotatable relative to the driver and rolls with a contact roller on the output fixed contacts, or a contact roller which is rotatably arranged on the axle of each contact bridge. Each contact bridge or contact roller directly cooperates with the control ramp through its control part. In these multiple switches the contact rollers are formed themselves as control parts which cooperate with the control paths or ramps.

German patent application DE C 8013 VIIIb/21c filed on Aug. 6, 1953 and published on Oct. 31, 1956 discloses a contact arrangement for switching devices with a contact roller. In this arrangement the contact roller for avoiding the damaging action of switching sparks and light arcs during the contact performs a small rotation and therefore the contact established during the following switching takes place at another location of the roller. The current is turned off and on in this contact arrangement in that a contact block is placed onto the outer surface of the contact roller or lifted from it. The contact surface of the contact block slightly deviates from the rectangular position relative to the movement direction of the contact block, so that the contact pressure does not extend through the center point of the roller. Thereby a torque is applied to the roller and results in a turning of the roller. Such a construction is however not suitable for the use in multi-position switches of the above mentioned type in which the contact of the contact rollers is obtained and interrupted by ramps.

The same is true for a further contact arrangement which is disclosed in the German document DE-GM 16 94 862 and is used for switching and regulating devices with contact rollers. Here the contact rollers are formed not cylindrically but for reducing the contact friction they have a spherical construction. The contact rails or contact paths can be flat and can be provided with a groove shaped depression. The contact rollers are inclined to produce a sliding movement which results first in a self cleaning during the switching process, and also due to the rotation of the contact rollers relative to the contact paths, other contact points are formed. This known contact arrangement is however not suitable for multi-position switches of the above mentioned general type for the reasons specified hereinabove.

U.S. Pat. 2,820,126 discloses a contact roller with a flanged peripheral surface which produces a rubbing friction during rotation of the contact roller about its longitudinal axis by a direct engagement with the contact surface on a fixed contact bench. Since the contact roller with its flanged peripheral surface can however come in contact directly with the outer surface of the fixed contact, the rubbing friction continuously changes because of the unavoidable contact burning at the contact roller. Therefore a controllable turning of the contact roller in each switching step is not possible.

Contact rollers with a contact surface which has an increased friction are disclosed for example in the German document DE-OS 29 09 585. Here the contact rollers are composed at least in the region of their outer cylindrical surface and at least locally, of rubber or other synthetic plastic which is made conductive due to addition of conductive particles (metal dust). The turning or displacing switch provided with such contact rollers has however a high wear resistance and operational safety, especially contact reliability, during selective connection of contact surfaces which are formed as conductor paths and are located relatively close to one another on an isolating material plate.

SUMMARY OF THE INVENTION

Accordingly, it is an object of the present invention to provide a multi-position switch of the above mentioned general type, which avoids the disadvantages of the prior art.

More particularly, it is an object of the present invention to provide a multi-position switch which has an improved service life and electrical loading capacity and therefore the reliability, obtained with simply technical means and in which the contact burning both on the rotatable contact points and also on the fixed contacts is better distributed over the whole contact surfaces.

In keeping with these objects and with others which will become apparent hereinafter, one feature invention resides, briefly stated, in a multi-position switch in which each contact bridge on its control part which comes into contact with the ramp has a peripheral surface which produces a rubbing friction for turning the contact bridge with the contact roller about their longitudinal axes.

The contact roller on its control part which comes into contact with the ramp can also have a peripheral surface which produces a rubbing friction for turning the contact roller about its longitudinal axis.

In both above described embodiments each contact bridge or contact roller on its control part which comes into contact with the control ramp has a peripheral surface which produces a rubbing friction in direction of turning of the contact bridge or the contact roller. This provides the advantage that the contact bridge or the contact roller is positively turned independently and separately from the electrical contact establishment when it comes in engagement with the control ramp. Since in the moment of contact of the control part of the contact bridge or the contact roller with the control ramp a minimal slippage occurs, before the contact roller or the contact with the contact roller mounted on it is displaced in rotation, the contact point is displaced on the periphery of the contact roller which forms the contact surface during each individual switching step in a stepped manner in a peripheral direction. Therefore during longer operational time, gradually step by step the whole periphery of the contact roller becomes available as contact points. As a result the possibility of a local contact burning at a periphery of the contact roller is substantially reduced and the service life of such a switch is substantially increased.

In accordance with another feature of the present invention, in order to produce the required rubbing friction for turning the contact roller or the contact bridge about their longitudinal axes, the peripheral surface of the control part can be provided with roughening or knurling.

On the other hand, the peripheral surface of the contact roller or the contact bridge which comes into contact with the control ramp, can be provided with suitable friction coating. The coating can be formed for example as an adhesive surface provided on the outer periphery of a plug sleeve.

In accordance with an especially advantageous feature of the present invention, on the contact roller of each contact bridge which rolls over the fixed contact can be conical or spherical. With increasing contact burning, on the periphery of the contact roller a burning displacement in direction of the longitudinal axis of the contact bridge is produced.

During continuous use of the switch a contact burning occurs on the outer periphery of the conical or spherical contact rollers which is in contact with the fixed contact. Thereby the diameter of the contact roller is reduced and the contact point between the contact roller and the fixed contact is displaced in direction of the longitudinal axis of the rotating contact bridge. As a result, clean, undamaged contact surfaces come into operation on these contact points. The thusly produced axial burning displacement increases the service life of the switch. The combination of the radial and axial burning displacement on the periphery of the contact roller, in addition to the ramp-controlled contact roller system basically improves the contact, this is an extraordinarily high electrical load capacity with long service life in such multiple switches, with simultaneous too low contact vibrations. This is especially important in modern motor management systems of power vehicles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
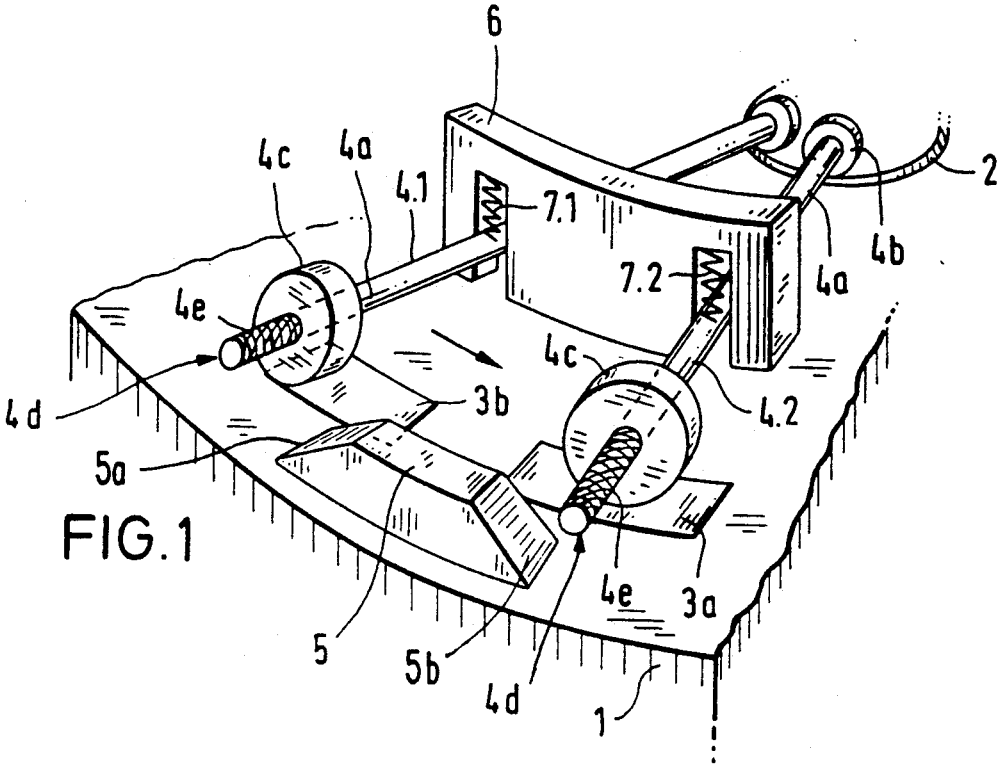
FIG. 1 is a view showing a principle sketch of main operational parts of an inventive switch in perspective.

FIG. 1 shows functional parts of the inventive multi-position switch which is formed for example as a turning switch. A base plate is identified as a whole with reference numeral 1 and only a part of it is shown. A central contact 2 is arranged in the center of the base plate 1, and serves for example as an input fixed contact. Outer fixed contacts 3, 3*a* and 3*b* are arranged on the base plate 1 closer to its periphery. Contact bridges 4.1 and 4.2 with their contact rollers 4*c* roll on the fixed contacts 3*a* and 3*b*. Both contact bridges 4.1 and 4.2 are formed with rotation-symmetrical contact parts 4*b*. They are in contact with the central contact 2 at the opposite end of the contact bridges.

The contact bridges 4.1 and 4.2 are arranged on a driver 6 which is turnable in a switch housing relative to the base plate 1. The action of pressure springs 7.1 and 7.2, provides for the required contact pressure between each contact bridge 4.1 and 4.2 and the central contact 2 and the also between the contact bridge 4.1 and 4.2 and fixed contacts 3*a* and 3*b*. Each contact bridge 4.1 and 4.2 is individually guided on the driver 6. Each contact bridge has an axle 4*a* which is freely rotatable relative to the driver 6, and two ends which rolls with their rotation-symmetrical contact parts on the central contact 2 and also on the outer fixed contacts 3*a* and 3*b*.

Figure 2:
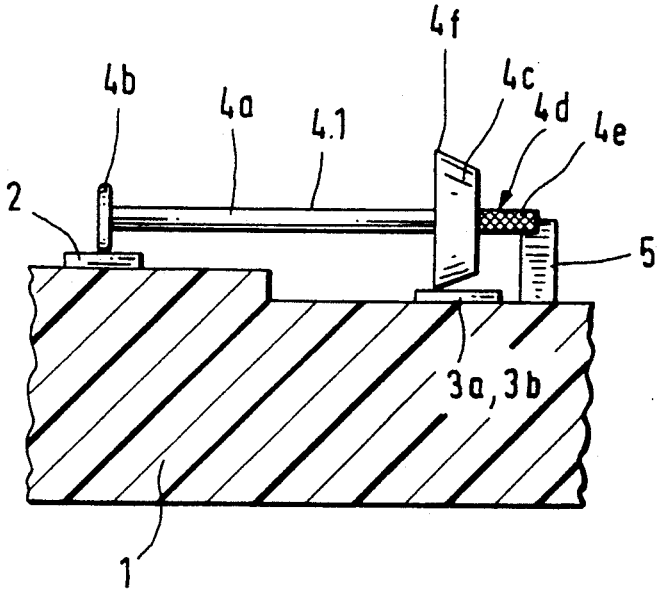
FIG. 2 is a view schematically showing a section through the switch with contact parts formed in accordance with the present invention.

As can be seen from FIGS. 1 and 2, the contact parts are formed of one piece with the axle 4*a* of each contact bridge 4.1 and 4.2. The contact part 4*b* which rolls on the central contact 2 can be formed as a contact roller which is of one piece with the axle 4a. It can be also formed as a contact ball which due to the radial arrangement of the contact bridges 4.1 and 4.2 on the driver 6, and therefore short rolling path on the central contact 2 has a correspondingly smaller diameter of a smaller rolling periphery than the contact roller 4c which rolls on the farther outwardly located fixed contact 3a, 3b of each individual contact bridge 4.1, 4.2. As can be further seen from FIGS. 1 and 2, each contact bridge 4.1 and 4.2, in addition to the contact roller 4c has a control part 4d which projects in direction of the longitudinal axis of the contact bridge radially outwardly. The control part 4d is formed as control projection and for each switching step comes into contact with a control ramp 5 having two sloping surfaces 5a and 5b and radially outwardly of the fixed contact 3a, 3b. The control part 4d has a peripheral surface which produces a rubbing friction for turning of the contact bridge 4.1 and 4.2 about their longitudinal axis. For this purpose it is provided either with a roughening or a knurling or a suitable rubbing friction coating 4e.

Figure 3:
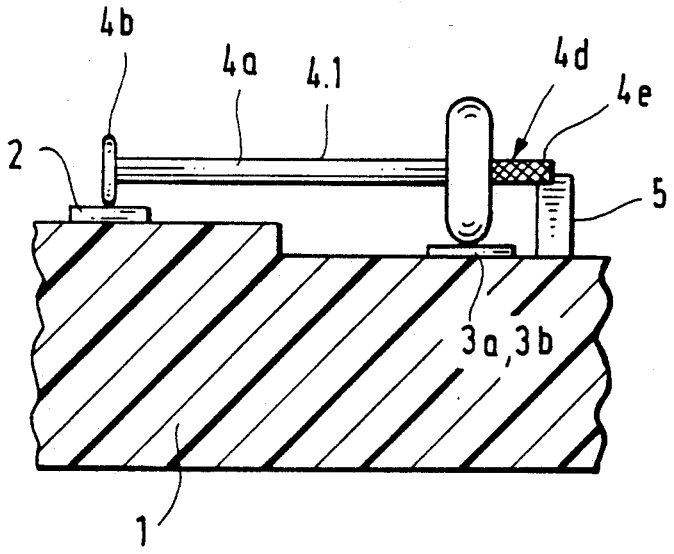
FIG. 3 is a view substantially corresponding to the view of FIG. 2 but showing another embodiment of the invention.

Moreover, the contact rollers 4c have a conical outer periphery 4f as shown in FIG. 2 or in some cases a spherical outer periphery as shown in FIG. 3. Therefore with increasing contact burning on the periphery of the contact roller 4c, an axial burning displacement in direction of the longitudinal axis of the contact bridge 4.1 and 4.2 is produced.

Due to the roughening, knurling or the rubbing friction coating 4e on the control projection of each contact bridge 4.1 and 4.2, they are forcibly rotated with their outer contact rollers 4c when they come in engagement with the control ramp 5. Thereby the contact point on the periphery of the contact roller 4c is displaced with each switching step so that with increasing operational life of the switch the whole periphery of the contact roller 4c is gradually made available as contact points.

Instead of the control projection, the roughening, knurling or a friction coating can be performed as a control projection of the control part 4d and can be a part of the control roller 4c, when the control roller is fixedly connected either with the axle 4a or is freely rotatable on the axle 4a.

The multiple switch in accordance with the present invention can be formed as a turning switch or as a displacing switch with a linear movement.

It will be understood that each of the elements described above, or two or more together, may also find a useful application in other types of constructions differing from the types described above.

While the invention has been illustrated and described as embodied in a multiple switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A multi-position switch, particularly for a motor vehicle, comprising a switch base; an input fixed contact arranged on said switch base; a plurality of output fixed contacts which can be connected with said input fixed contact; a ramp; contact bridges controlled by said ramp and bringing said output fixed contacts in contact with said input fixed contact; a driver movable relative to said switch base and individually supporting and guiding said contact bridges; spring means providing a required contact pressure between said contact bridges and said input fixed contact and also between said contact bridges and said output fixed contacts, each of said contact bridges having an axle which is freely rotatable relative to said driver and carries a contact roller rolling on said output fixed contacts, each of said contact bridges being provided with a control part which comes into contact with said ramp and has a peripheral surface which produces a rubbing friction for turning each of said contact bridges about its longitudinal axis.

2. A multi-position switch as defined in claim 1, wherein said peripheral surface of said control part has a roughening.

3. A multi-position switch as defined in claim 1, wherein said peripheral surface of said control part has a knurling.

4. A multi-position switch as defined in claim 1, wherein said control part is provided with a rubbing coating to form said peripheral surface.

5. A multi-position switch as defined in claim 1, wherein said contact roller is conical.

6. A multi-position switch as defined in claim 1, wherein said control part with said peripheral surface which produces a rubbing friction is provided on said axle of each of said contact bridges.

7. As defined in claim 1, wherein said control part which has said peripheral surface which produces a rubbing friction is arranged on said contact roller of each of said contact bridges.

8. A multi-position switch as defined in claim 1, wherein said contact roller is spherical.

* * * * *